US005175587A

United States Patent [19]

Kato et al.

[11] Patent Number: 5,175,587

[45] Date of Patent: Dec. 29, 1992

[54] DEVELOPING APPARATUS HAVING A DETACHABLE DEVELOPER CARTRIDGE

[75] Inventors: Keiji Kato, Nara; Toshiyuki Kurosaka, Kyoto; Hiroshi Kawahito, Kita-Katsuragi; Hideaki Hagihara, Nara, all of Japan

[73] Assignee: Sharp Kabushiki Kaisha, Osaka, Japan

[21] Appl. No.: 751,922

[22] Filed: Aug. 29, 1991

[30] Foreign Application Priority Data

Aug. 31, 1990 [JP] Japan ..... 2-231157

[51] Int. Cl.[5] ..... G03G 15/06

[52] U.S. Cl. ..... 355/260; 222/DIG. 1

[58] Field of Search ..... 355/245, 260, 251, 259; 118/653, 656-658; 141/346-348, 363, 364; 220/345, 346; 206/527; 222/DIG. 1, 325

[56] References Cited

U.S. PATENT DOCUMENTS

| | | | |
|---|---|---|---|
| 4,491,161 | 1/1985 | Tamura et al. | 141/364 |
| 4,878,091 | 10/1989 | Morita et al. | 355/260 |
| 4,972,887 | 11/1990 | Hacknauer et al. | 355/260 X |
| 5,040,025 | 8/1991 | Fukuchi | 355/260 |

FOREIGN PATENT DOCUMENTS

| | | | |
|---|---|---|---|
| 0179377 | 7/1988 | Japan | 355/260 |
| 0220185 | 9/1988 | Japan | 355/260 |
| 0142763 | 6/1989 | Japan | 355/260 |
| 0262570 | 10/1989 | Japan | 355/260 |

*Primary Examiner*—A. T. Grimley
*Assistant Examiner*—William J. Royer
*Attorney, Agent, or Firm*—David G. Conlin; Donald R. Castle

[57] ABSTRACT

A developing apparatus includes a first locking means for locking a first supplying lid disposed at a first supplying opening in a closing position, a second locking element for locking a second supplying lid of a second supplying opening in a closing position, and a lock release element for releasing only the second locking element when a detachable developer cartridge is used. The second locking element includes a concave portion formed on a peripheral wall of the second supplying opening and a lock piece disposed in the concave portion, and a hole formed at an edge of the second supplying lid. The lock piece engages the hole when the second supplying lid is closed, thereby the lid is locked. The lock release element includes a lid having a opening disposed at an upper surface of the developing apparatus and a hole disposed at the lock piece, and the detachable developer cartridge comprises a pair of lock release pieces. The hole engages only the lock release piece for releasing the locking of the second supplying lid when the developer cartridge is mounted on the developing apparatus.

18 Claims, 17 Drawing Sheets

DEVELOPING APPARATUS HAVING A DETACHABLE DEVELOPER CARTRIDGE

BACKGROUND OF THE INVENTION

1. Field of the Invention

The present invention relates to a developing apparatus used for copying machines, laser printers, and facsimiles, and a developer cartridge used for the developing apparatus.

2. Description of the Related Art

There are two types of developing apparatus with two-component developer (carrier and toner). One of them is provided with a single developer tank for two-component developer. In such developing apparatus it is necessary to supply first developer (carrier only or a mixture of a carrier and a toner) and second developer (toner) in regular order. A developer cartridge in which the first developer and the second developer are separately involved and sealed so as to be easy to supply in regular order these developers and a developing apparatus with such the developer cartridge are disclosed in Japanese Patent Application Laid-Open Publications Nos. 60 (1985)-165676, 61 (1986)-93469, and 61 (1986)-93470.

Another type of developing apparatus includes a first developer tank for the first developer and a second developer tank for the second developer. In such latter developing apparatus it is not necessary to be provided with a mechanism for supplying in regular order the developers to the developing apparatus.

However, when a user opens a lid of the supplying opening for initial setting before use or for replenishment of the second developer in use so as to supply the developer, there is given such a problem that the second developer may be introduced into a developer tank through the first developer supplying opening by mistake.

In addition, on the contrary, there is such a problem that the first developer may be introduced into the second developer tank.

SUMMARY OF THE INVENTION

It is therefore an object of the present invention to provide a developing apparatus which is capable of preventing miss introduction of an unsuitable developer into a developer tank.

Another object of the present invention is to provide a developing apparatus and a developer cartridge which are capable of preventing a supplying lid from locking during shipment or transport of the developing apparatus, and then this allows a user to supply a developer into the developing apparatus without any trouble.

A further object of the present invention is to provide a developing apparatus which is capable of preventing a supplying lid from unclosing even if the supplying lid is warped.

A developing apparatus includes a developing tank with a developing roller and a first supplying opening for supplying a first developer containing magnetic particles, a developer replenishing tank disposed adjacent to the developing tank, having a second supplying opening for supplying a second developer containing a non-magnetic developer, and which includes first and second supplying lids disposed at the first supplying opening and the second supplying opening respectively. The apparatus further comprises a first locking means for locking the supplying lid of the first supplying opening in a closing position, a second locking means for locking the supplying lid of the second supplying opening in a closing position, and a lock release means for releasing only the second locking means when a detachable developer cartridge is used.

The second locking means includes a means for locking the second supplying lid automatically when it is closed, and the second locking means is not released during the use of the developing apparatus except that the detachable developer cartridge is mounted on the developing apparatus.

The detachable developer cartridge comprises a release member and the lock release means of the developing apparatus engages only the release member in order to release the second supplying lid.

The first locking means includes a means for locking the first supplying lid when it is closed, and the first locking means is not released during the use of the developing apparatus. Preferably, the first locking means comprises a pawl disposed at a end portion of the supplying lid and a stop disposed at a peripheral wall of the first supplying opening. The stop engages the pawl when the supplying lid is closed and then the lid is locked.

The second locking means includes a first lock member disposed movably at a peripheral wall of the second supplying opening and a second lock member disposed at an edge of the supplying lid, and the first lock member engages the second lock member when the second supplying lid is closed. Preferably, the second locking means includes a concave portion formed on a peripheral wall of the second supplying opening, a lock piece disposed in the concave portion, a hole formed at an edge of the supplying lid, and a spring fitted around a rod projected at an end portion of the lock piece. The lock piece engages the hole when the second supplying lid is closed and the lock piece is inserted into the hole by force of the spring, and then the lid is locked.

The lock release means includes a first member disposed adjacent to the second locking means and a second member disposed at the second locking means, and both the first member and the second member engages the release member of the detachable developer cartridge for releasing the locking of the second supplying lid. The lock release means may comprise a lid having a opening disposed at an upper surface of the developing apparatus and a hole engaging a lock release piece disposed at the detachable cartridge for releasing the locking of the supplying lid at the second supplying opening.

Advantages of the above-mentioned apparatus are such that miss operations can be prevented during introduction of the developer into the replenishing tank. This allows the developer to be introduced only when the detachable developer cartridge is installed to the second supplying opening, that is, if the cartridge is not mounted on the developing apparatus the developer is never introduced into the replenishing tank. In addition, because the developing tank is certainly sealed by the locking means, it is prevented that a user introduces the developer from the exterior without the detachable developer cartridge.

According to a preferred embodiment, there is provided with a lock preventing member for preventing actuation of each of the locking means before first supply of the first developer and the second developer to the developing apparatus and the lock preventing means covers both the stopper and the lock piece to prevent them from engaging the corresponding portions. The lock preventing means may include a single sheet having functions for preventing the supplying lids from being locked and opened before initial setting of the developers.

Advantages of the above-mentioned apparatus are such that locking and opening of the supplying lids can be prevented during shipment or transport of the developing apparatus. This also prevents a user to be unable to supply the developer into the developing apparatus on the initial setting time.

Preferably, a pair of supporting portions for mounting the detachable developer cartridge during replenishment of the developer is disposed on an upper surface of the developing apparatus both the locking means and the lock release means is at an inner side with respect to the supporting portions on the surface.

Advantages of the above-mentioned apparatus are such that it can prevents the supplying lid from unclosing even if the supplying lid is warped.

According to the invention, there is also provided with a developer cartridge having a release member. This developer cartridge is used for supplying developer to the above-mentioned developing apparatus, wherein the release member may include a pair of lock release pieces disposed at a inner side with respect to a pair of angles having a shaft. The shaft is fitted at the supporting member and the lock release piece engages the lock release means of the developing apparatus when the cartridge is mounted on the developing apparatus for replenishing the developer.

Further objects and advantages of the present invention will be apparent from the following description of the preferred embodiments of the invention as illustrated in the accompanying drawings.

DESCRIPTION OF THE PREFERRED EMBODIMENTS

Hereinafter, embodiments of the developing apparatus and the developer cartridge according to the present invention will be described in detail with reference to the accompanying drawings.

Figure 1:
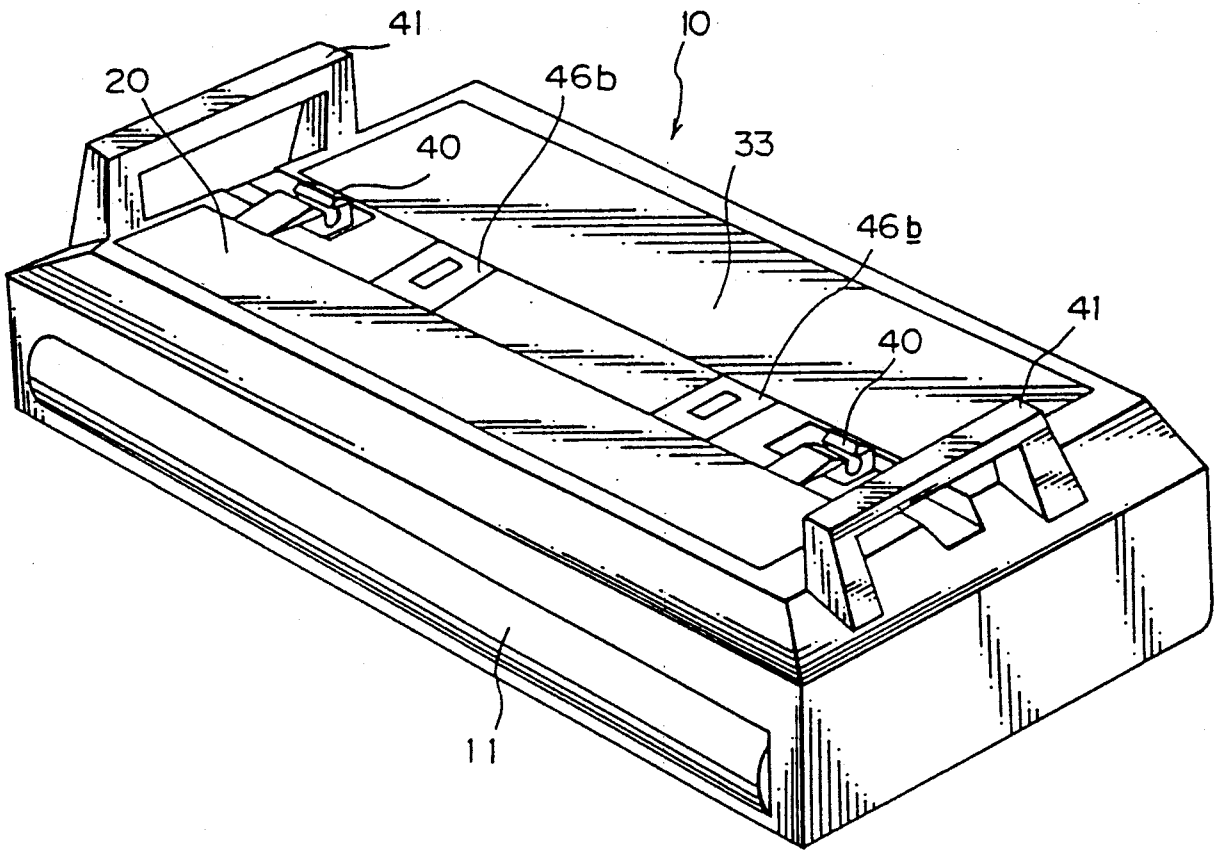
FIG. 1 represents a perspective view of an embodiment of the developing apparatus according to the present invention.

As shown in FIG. 1, a developing apparatus 10 is provided with a container of a rectangular parallelopiped, and a pair of handles 41 are attached at both end portions in the longitudinal direction on an upper surface of the container. In addition, supplying lids 20 and 33 are provided at the upper surface of the container, and a part of developing roller 11 is projected from a side wall of the container on the side of the supplying lid 20. The above-mentioned construction can been seen more clearly from a cross-sectional view of FIG. 2.

Figure 2:
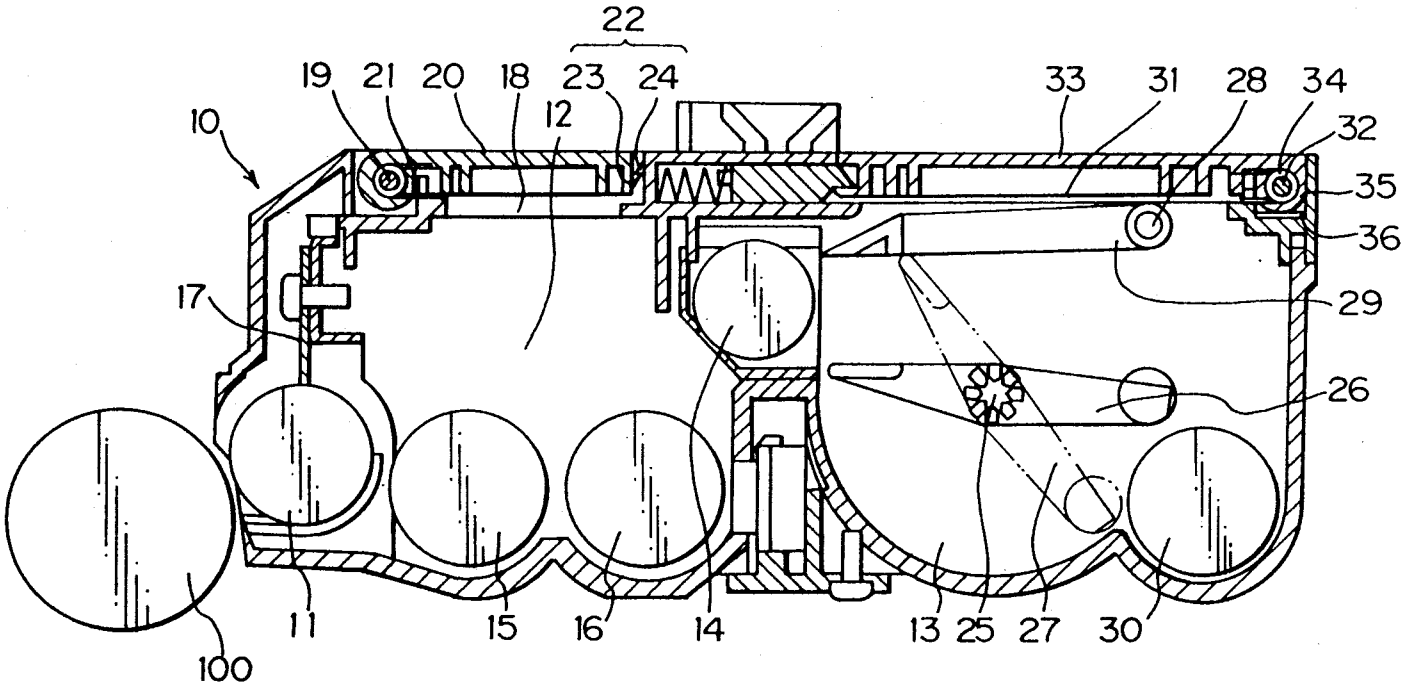
FIG. 2 represents a cross section of the developing apparatus shown in FIG. 1.

As shown in FIG. 2, the developing apparatus 10 is provided with a developing tank 12 having the developing roller 11 and a replenishing tank 13 disposed adjacent to the developing tank 12. The replenishing tank 13 is isolated from the developing tank 12 by a wall so as to communicate only through a passage in which a replenishing roller 14 is disposed. The developing roller 11 is disposed at a side end portion of the developing tank 12 adjacent to a photosensitive drum 100, two stirring rollers 15 and 16 are provided at a bottom portion in the developing tank 12, and a doctor plate 17 is arranged near the upper surface of the developing roller 11.

The developing apparatus 10 of this embodiment uses two kinds of developer. First developer is composed of carrier such as magnetic particles or of mixture of carrier and toner, and second developer is composed of only toner.

A first supplying opening 18 for the supplying the first developer is formed at an upper portion of the developing tank 12. A supplying lid 20 which is rotatable around a shaft 19 attached to an edge of the opening 18 is disposed to cover the opening 18. A coil spring 21 for energizing the supplying lid to open it is mounted around the shaft 19. The supplying lid 20 is provided with a first locking means 22 constituted by a pawl 23 formed at an end portion of the supplying lid 20 and a stop 24 engaging the pawl 23 formed at a peripheral wall of the opening 18.

The replenishing tank 13 is provided with the replenishing roller 14 for feeding and second developer to the developing tank 12, a pair of stirring plates 26 and 27 attached rotatably around a shaft 25 for sending the second developer to the replenishing roller 14, a scooping plate 29 mounted movably around a shaft 28 above the stirring plates 26 and 27, and a stirring roller 30 at a bottom portion for stirring the second developer. A second supplying opening 31 for supplying the second developer is formed at an upper portion of the replenishing tank 13. A supplying lid 33 which is rotatable around a shaft 32 attached to an edge of the opening 31 is disposed to cover the opening 31. A coil spring 34 is fitted to the shaft 32. One end of the spring is fixed to a peripheral edge of the replenishing tank 13 and the other end is fixed to the supplying lid 33 in order to energize the supplying lid 33 in the opening direction.

A boss 35 of the supplying lid 33 which engages with the shaft 32 has a circular cross section. The boss 35 abuts on a buffer portion 36 made of suede attached at an edge of the opening 31, so that the supplying lid 33 can open slowly when it begins to move from its closing position to its opening position by energizing force of the coil spring 34.

Figure 3:
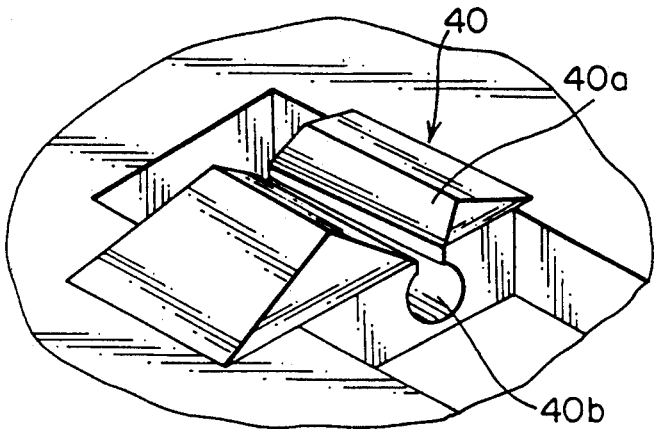
FIG. 3 represents a perspective view of the supporting portion of the developer cartridge.

As shown in FIG. 1 a pair of supporting members 40 used for mounting a detachable developer cartridge (not shown in this figure) and a pair of lids **46*b* which is a integral part of a lock release means are also attached at an upper surface of the container. The shape of the supporting member 40 can be more clearly seen in FIG. 3. As shown in FIG. 3, the supporting member 40 includes a tapered surface 40*a* having an opening and a bearing stand 40*b*** for fitting a shaft of the detachable cartridge when it is mounted on the developing apparatus.

Figure 4:
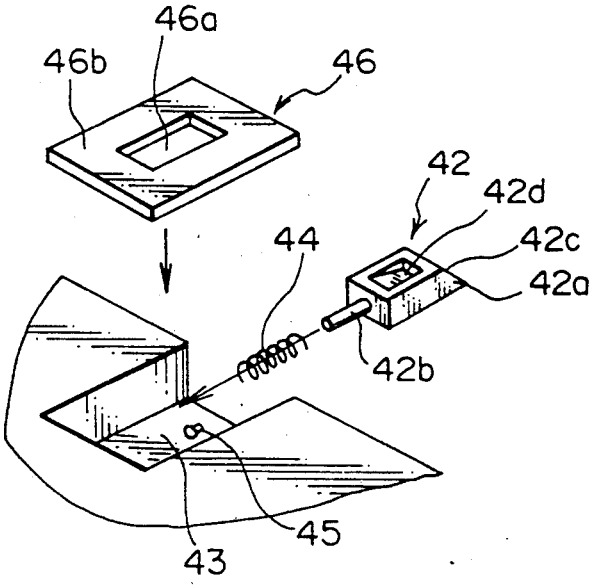
FIG. 4 represents a exploded view of the second locking means and the lock release means.
Figure 5:
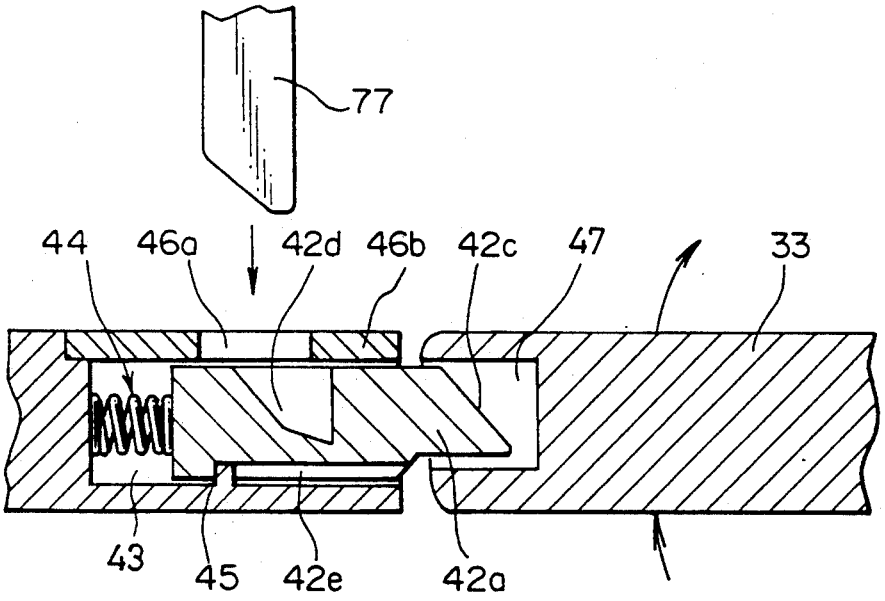
FIG. 5 represents a cross section of the second locking means and the lock release means.

Inside the lids **46*b* on the container there is provided with a second locking means 42 as shown in FIG. 4. The second locking means 42 is constituted by a concave portion 43 formed at a peripheral wall of the opening 31, a lock piece 42*a* mounted in the concave portion 43, a spring 44 for energizing the lock piece 42*a* toward the side of the opening 31, and a hole 47 formed at an edge of the supplying lid 33 as shown in FIG. 5**.

The spring 44 is a compression coil spring and it is fitted around a core rod **42*b* projected at an end portion of the lock piece 42*a*. That is to say, the spring 44 is held between the lock piece 42*a* and a side wall of the concave portion 43. Thereby the lock piece 42*a* can be moved toward the opening 31 by the spring 44 and moved backward against the spring 44 by pushing a forward end of the lock piece 42*a***.

Because the forward end of the lock piece **42*a* is tapered, a lower edge of the supplying lid 33 abuts smoothly on the tapered surface 42*c* when the lid is closed. Closing the lid causes the lock piece 42*a* to move against the spring 44, so that the lid can be closed smoothly. When the supplying lid 33 is closed completely, the hole 47 engages with the lock piece 42*a* and then the lid 33** is certainly locked.

In order to prevent the lock piece **42*a* from getting out of the concave portion 43 by force of the spring 44, a stopper 45 is formed at a bottom surface of the concave portion 43 and a groove 42*e* engaging the stopper 45 is formed at a bottom surface of the lock piece 42*a***.

As shown in FIG. 4, a lock release means 46 is constructed by the lid **46*b* which covers the concave portion 43 of the second locking means 42, and a hole portion 42*d* formed at an upper surface of the lock piece 42*a*. The lid 46*b* is provided with an opening 46*a* for being penetrated by a lock release piece 77 (see FIG. 5) of a detachable developer cartridge as described hereinafter. Then the lock release piece 77 is inserted into the hole portion 42*d* through the opening. By pressing down the lock release piece 77 against the hole portion 42*d*, the lock piece 42*a* is forced to move backward against the spring 44 and then the supplying lid 33 is opened. In this embodiment, in order to make this operation easily a size of an aperture of the hole portion 42*d*** is smaller step by step from the opening portion to the bottom portion.

Figure 6:
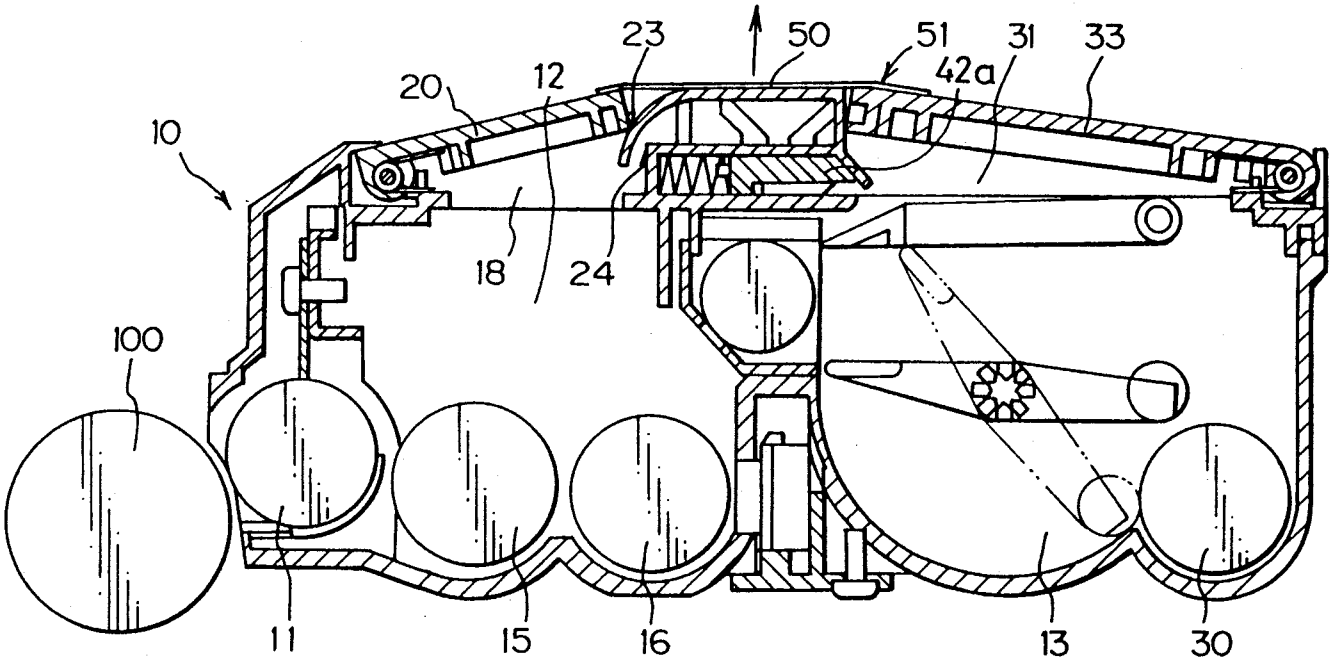
FIG. 6 represents a cross section of the developing apparatus during shipment.

In a preferable embodiment, as shown in FIG. 6, the developing apparatus 10 during shipment is provided with a lock preventing member 50 for preventing the supplying lids 20 and 33 from being locked and opened. This lock preventing member 50 is attached to an upper surface of the developing apparatus 10 so as to cover both the stop 24 and the lock piece **42*a*, and a tape 51 is adhered at an upper surface of the lock preventing member 50 in order to prevent opening of the supplying lids 20 and 33**.

Figure 7:
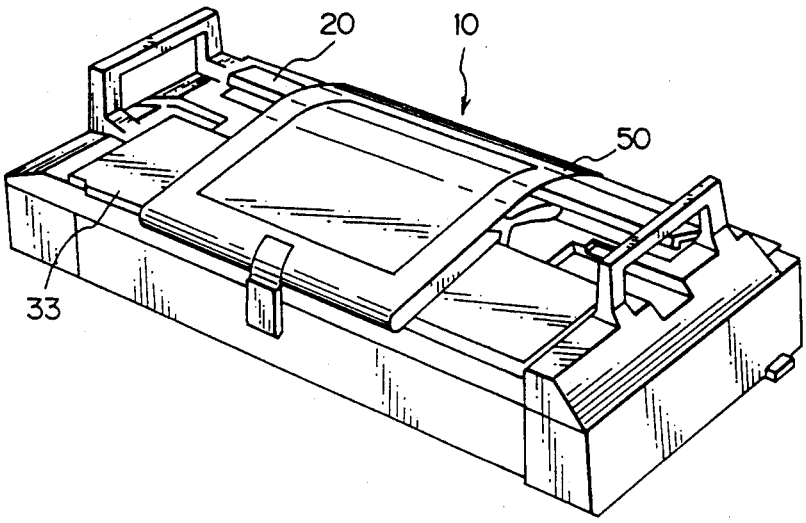
FIG. 7 represents a perspective view of an example of the developing apparatus during shipment.

The lock preventing member 50 may be constituted by a single sheet having a function for preventing the supplying lids 20 and 33 being locked respectively and a function for preventing opening of the supplying lids 20 and 33 as shown in FIG. 7.

Figure 8:
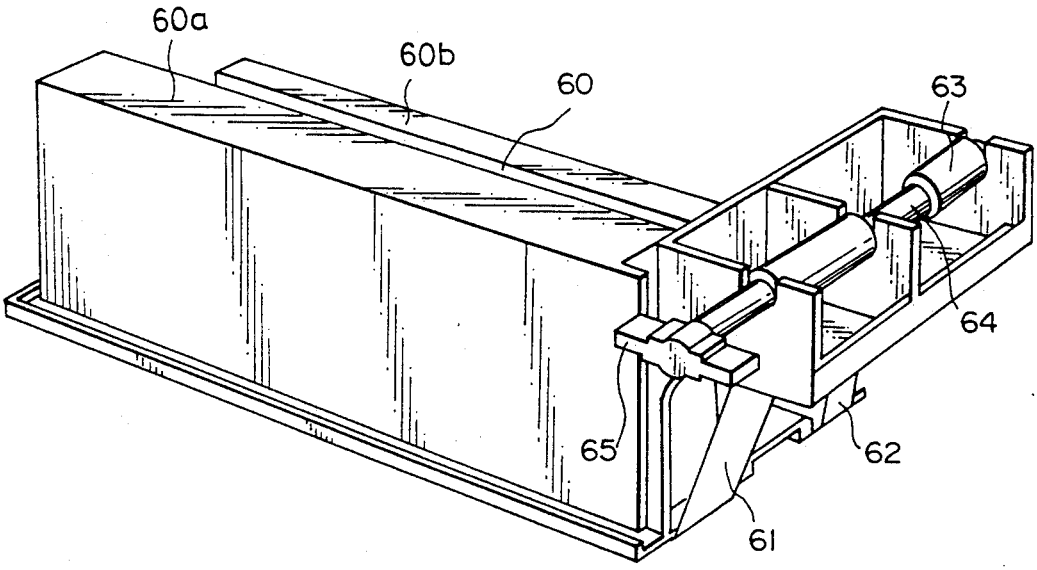
FIG. 8 represents a perspective view of the cartridge for storing the first developer and the second developer.

There are two types of the developer cartridge, one of them is a developer cartridge 60 which stores both the first developer and the second developer as shown in FIG. 8 and the other is an developer cartridge 70 which stores only the second developer as shown in FIG. **9*a*. The developer cartridge 60 is used for initial setting and the developer cartridge 70** is used for replenishing the second developer.

As shown in FIG. 8, seal members 61 and 62 are adhered to each opening of two containers **60*a* and 60*b* for storing the first developer and the second developer respectively and each one end portion of the seal members are fixed to a winding portion 63 of a rotational shaft 64 disposed at a side portion of the cartridge 60. The other end portions are fixed at each one peripheral edge of the openings respectively. The seal members are peeled off together from the openings by rotating a handle 65**.

The developer cartridge 70 is constructed in the same manner as the developer cartridge 60 as shown in FIG. **9*a*. A seal member 71 is adhered for sealing an opening, and an end portion of the seal member 71 is fixed to a winding portion 72 of a rotational shaft 73 disposed at a side portion of the cartridge. The other end portion is fixed at a peripheral edge of the opening. There is provided a handle 74 at an end portion of the rotational shaft 73 so as to peel off the seal member 71 from the opening by rotating the handle 74**.

A pair of angles 75 with a shaft 76 is fixed to a lower end portion of one side surface of the developer cartridge 70, and a pair of lock release pieces 77 is fixed to an inner side on the same surface with respect to these angles 75. The lock release piece 77 is formed to be adapted for inserting into the hole portion **42*d* of the lock piece 42*a* in order to press the lock piece 42*a* to move against the spring 44 (see FIG. 5**).

The seal member 71 is folded at the other peripheral edge of the opening, thereby the opening is sealed doubly by the seal member as shown in FIG. **9*b*. The developer cartridge 60** has the same construction.

In the following, operations of initial setting the first and second developer and the replenishment of the second developer are described with reference to FIGS. 10 to 18.

When a user purchases a copying machine, a laser printer, a facsimile or the like having the above-mentioned constitution, he first takes off the tape 51 of the developing apparatus as shown in FIG. 6 in order to supply the first developer (mixture of carrier and toner, or carrier only) and the second developer (toner).

Figure 10:
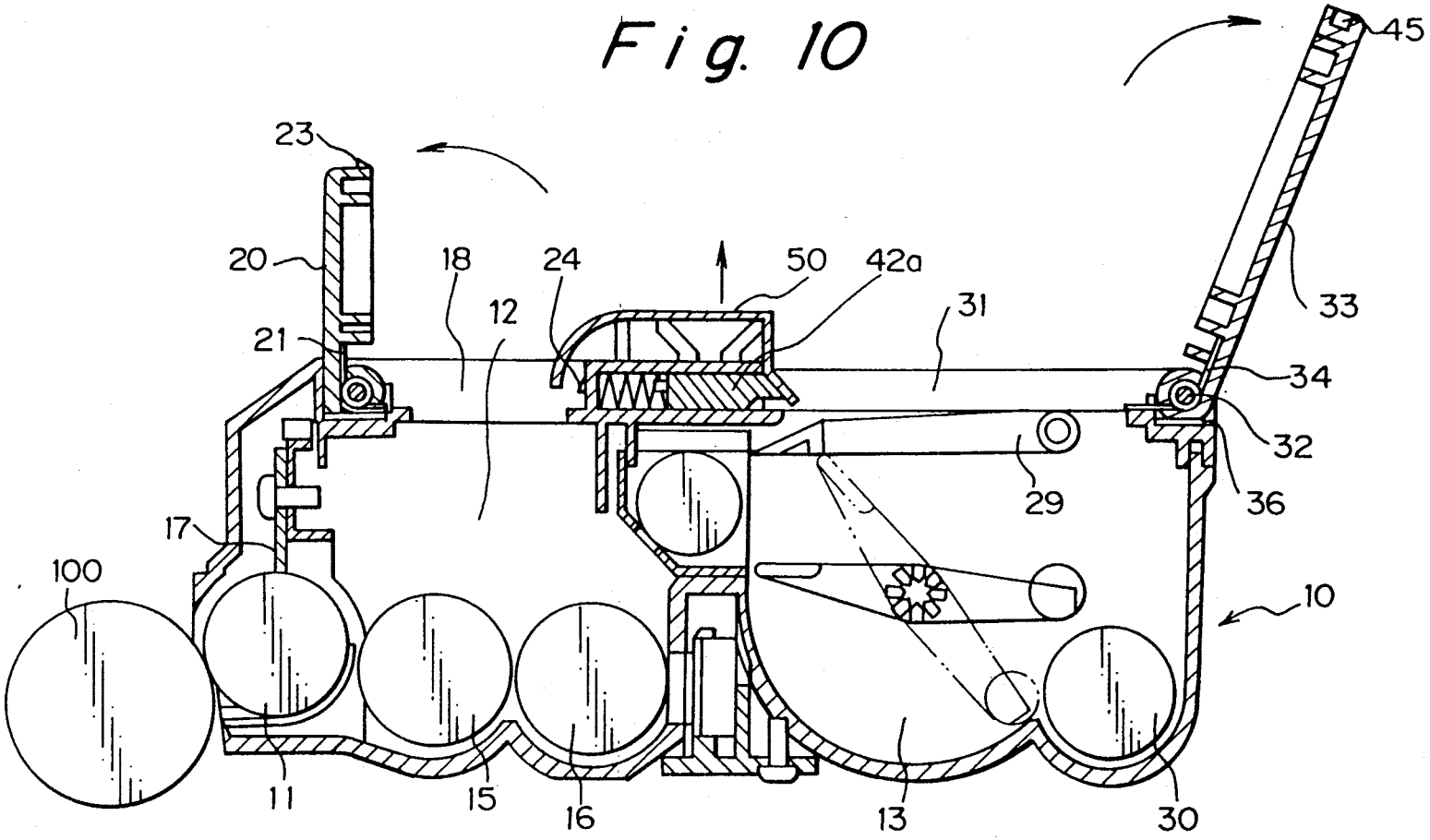
FIG. 10 represents a cross section of the developing apparatus before introduction of the developer.

Then, as shown in FIG. 10, the supplying lids 20 and 33 are released by the energizing force of the springs 21 and 34 respectively. Due to the lock preventing member 50 the supplying lids are never closed during shipment, and on the contrary taking off the tape by the user certainly leads to opening of the supplying lids.

Figure 11:
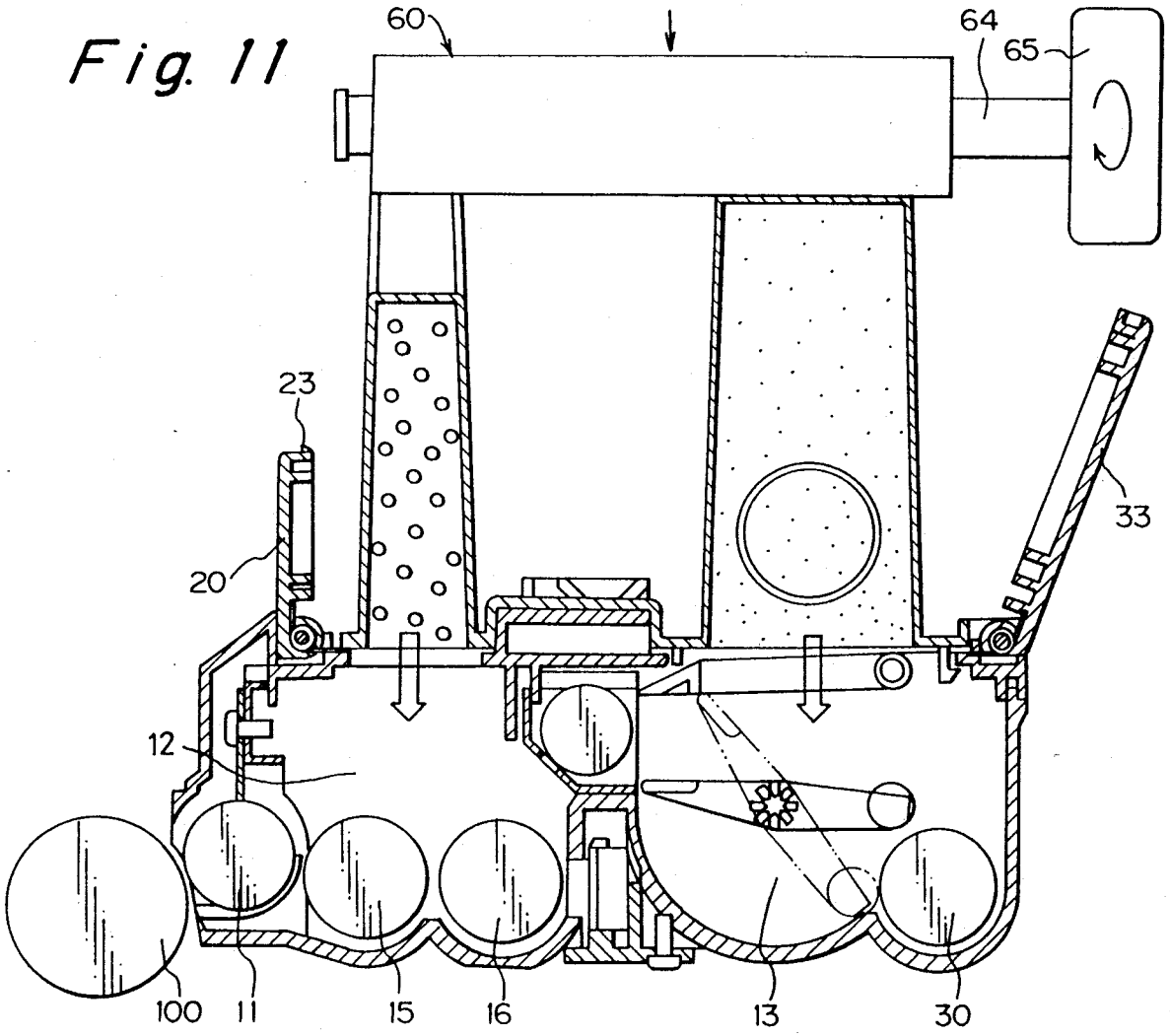
FIG. 11 represents a cross section of the initial cartridge and the developing apparatus during introduction of the developer.
Figure 12:
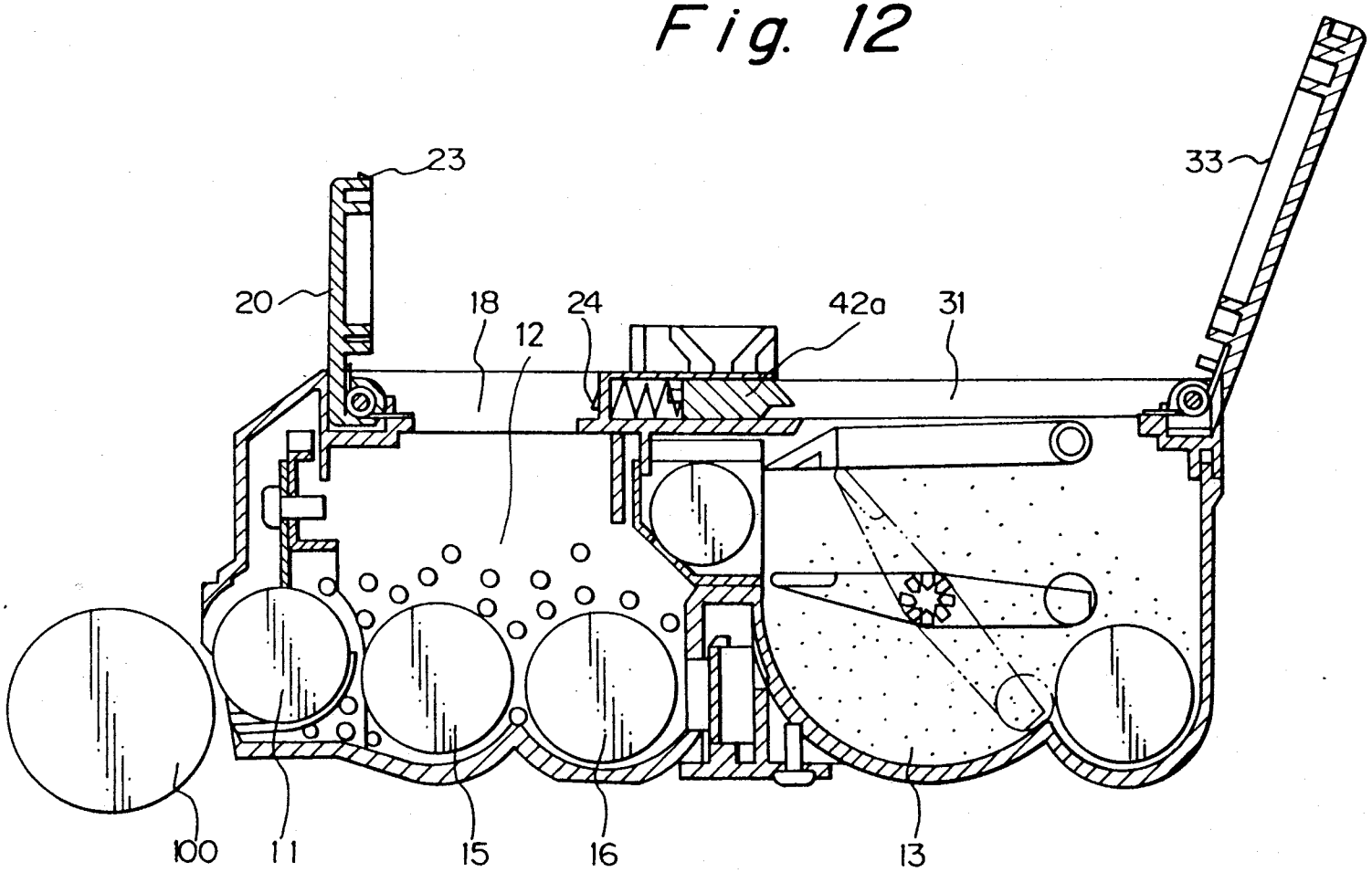
FIG. 12 represents a cross section of the initial cartridge and the developing apparatus after introduction of the developer.

Next, the lock preventing member 50 is removed from the developing apparatus 10. The user installs the initial cartridge 60 for initial setting to the developing apparatus 10. The initial cartridge 60 and the developing apparatus 10 during this installation is shown in FIG. 11. And then, the seal members for sealing the openings of the cartridge are peeled off by means of rotating the handle 65, and the first developer is supplied into the developing tank 12 and the second developer is supplied into the replenishing tank 13.

Figure 13:
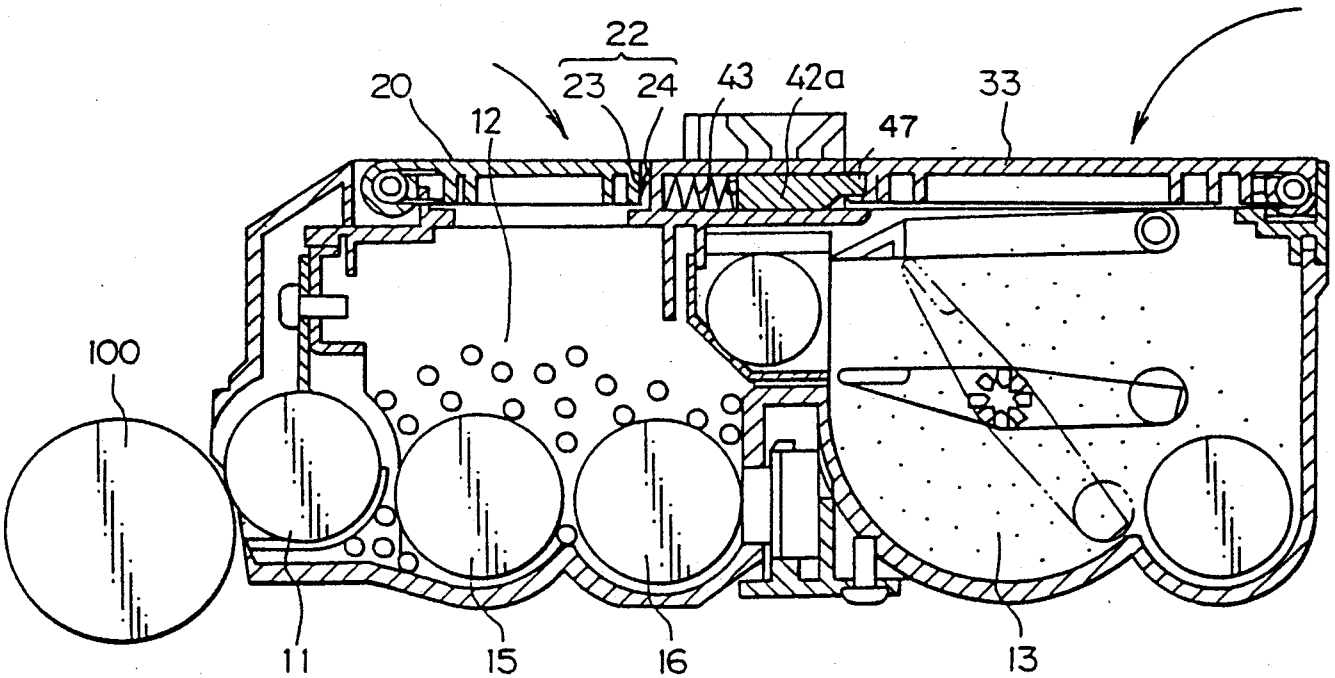
FIG. 13 represents a cross section of the developing apparatus wherein the supplying lid being in a closed state after introduction of the developer.

The initial cartridge 60 is removed from the developing apparatus 10 (see FIG. 12), and the supplying lids 20 and 33 are closed. The developing apparatus 10 in this situation is shown in FIG. 13. When the supplying lid 20 is closed, the pawl 23 of the first locking means 22 engages the stop 24 of the supplying opening 18 for locking the supplying lid 33. When the supplying lid 33 is closed, the lock piece 42*a* of the second locking means 42 is pushed against the springs 43 by the supplying lid 33 and then it faces to the hole 47 of the supplying lid 33. Then the lock piece 42*a* is inserted into the hole 47, thereby the supplying lid 33 is locked. Thus, the supply of the developers to the developing apparatus 10 is completed.

Next, a method for replenishing the second developer (toner) during the use of the developing apparatus 10 will be explained.

Figure 14:
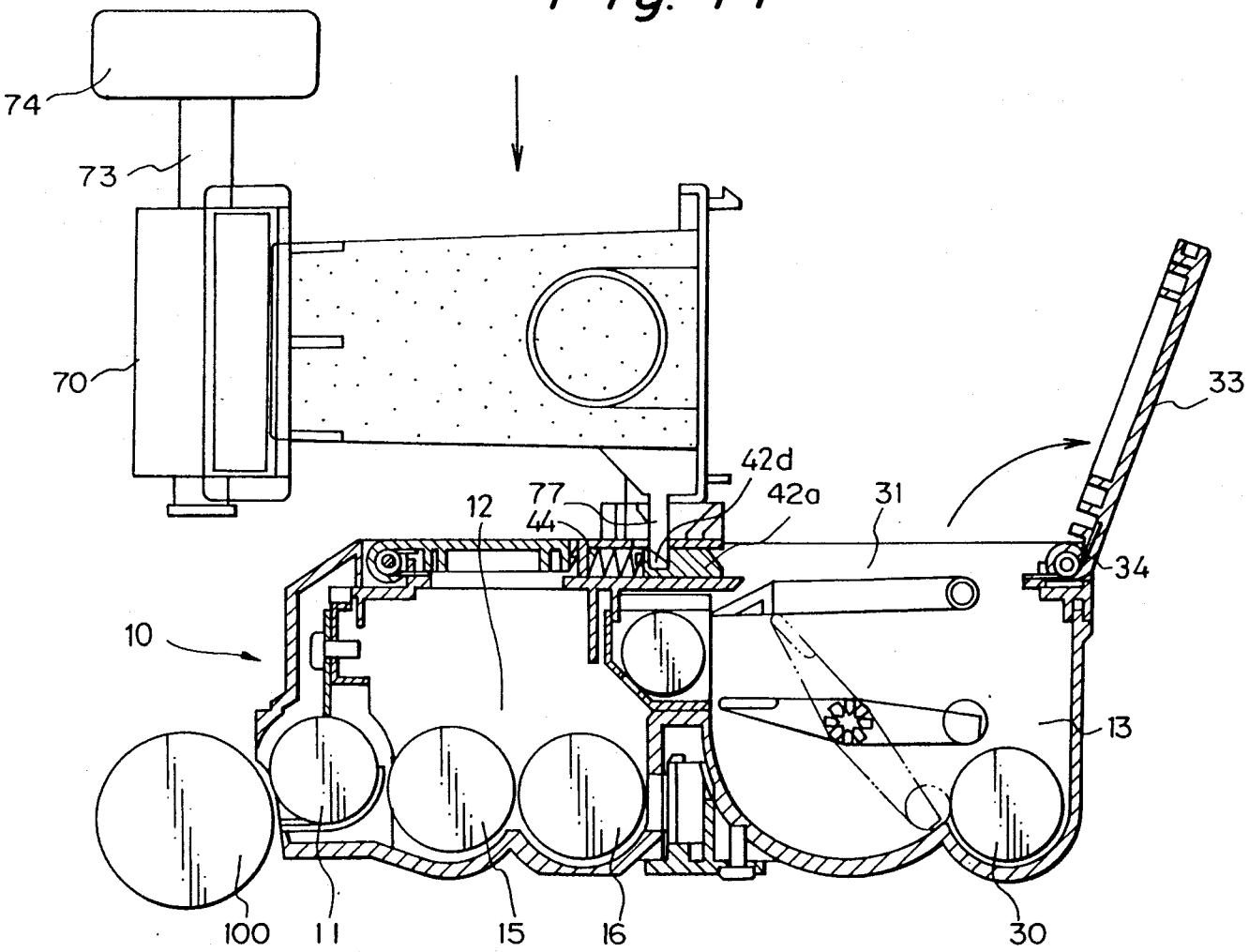
FIG. 14 represents a cross section of the developing apparatus in a state wherein the exclusive cartridge being installs.

The cartridge 70 is mounted so that its side surface having the lock release pieces 77 is parallel with the upper surface of the developing apparatus 10 as shown in FIG. 14. And then the cartridge 70 is pushed in downwardly, and the lock release piece 77 enters into the hole portion 42*d* of the lock piece 42*a*, thereby the lock release piece 77 forces the lock piece 42*a* to move rearward against the spring 44 while contacting with a side wall of the hole portion 42*d*. This allows the locking of the supplying lid 33 to be released and the supplying lid 33 of the replenishing tank 13 is opened by force of the spring 44.

Figure 15:
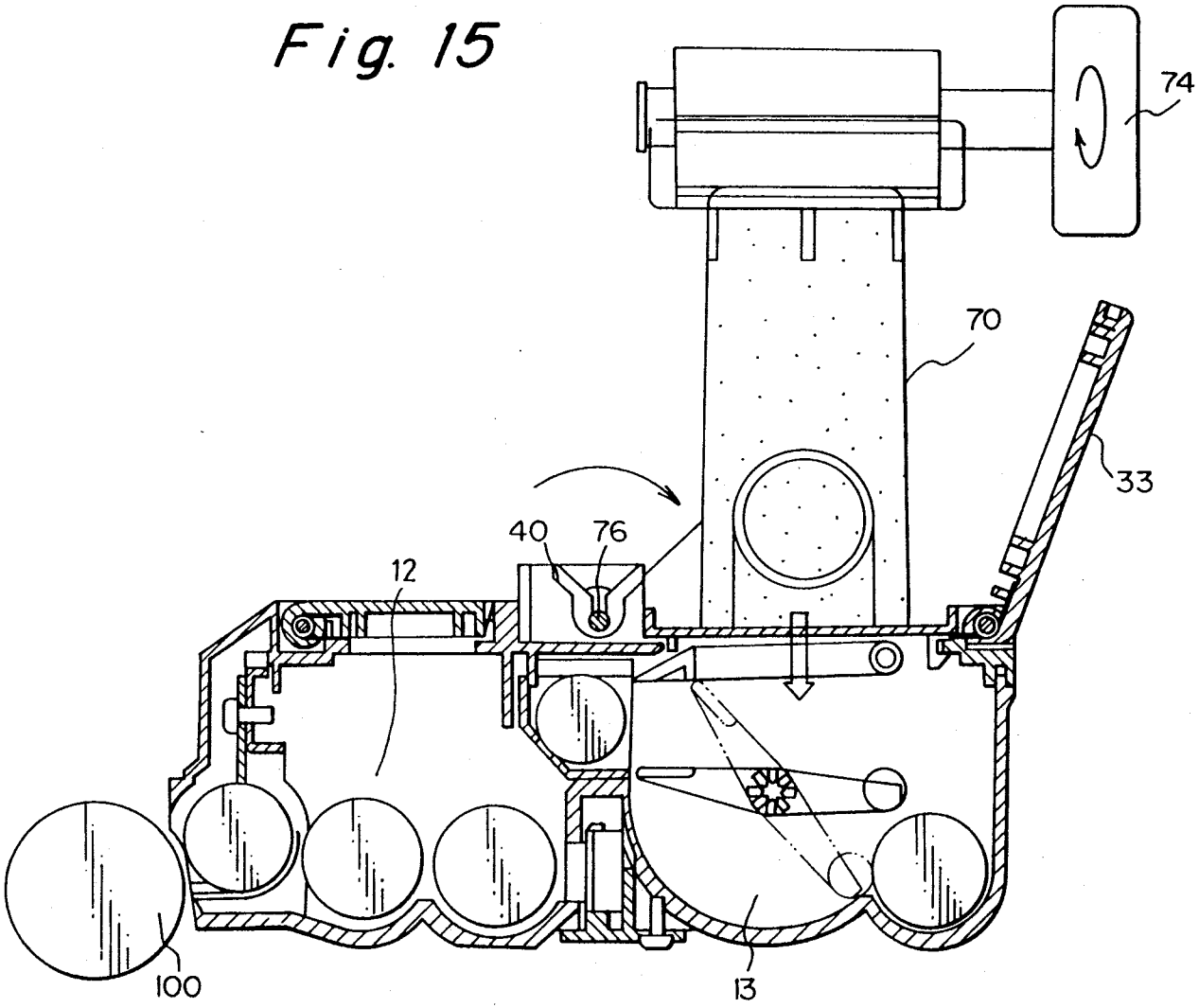
FIG. 15 represents a cross section of the developing apparatus during introduction of the developer of the exclusive cartridge.
Figure 16:
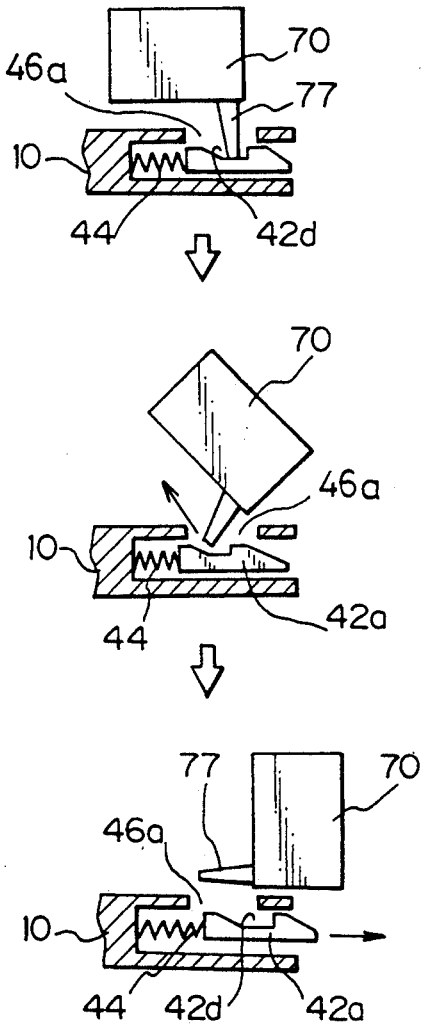
FIG. 16 represents a cross section showing actions of the locking means and the lock release means.
Figure 17:
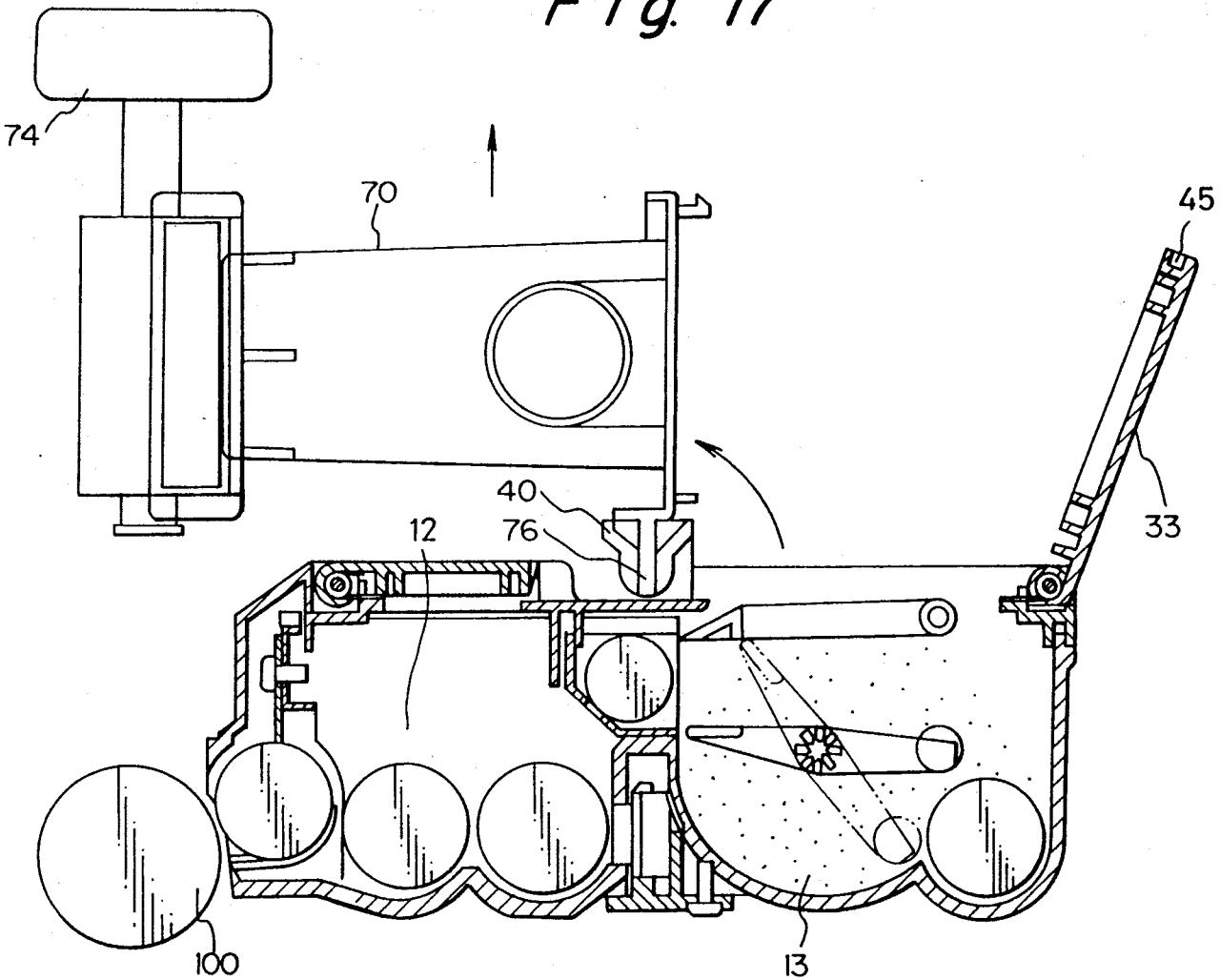
FIG. 17 represents a cross section of the developing apparatus showing a state after introduction of the developer of the exclusive cartridge.

Next, the cartridge 70 is rotated by an angle of 90 degrees around the supporting member 40, as shown in FIG. 15, and then preparation for replenishment of the toner is completed. As shown in FIG. 16, the opening 46*a* has enough aperture size that the lock release piece 77 of the cartridge 70 can pass through the opening while sliding on a side wall of the lock piece 42*a* during the rotational movement, thereby the rotational movement of the cartridge 70 can be carried out smoothly.

Figure 18:
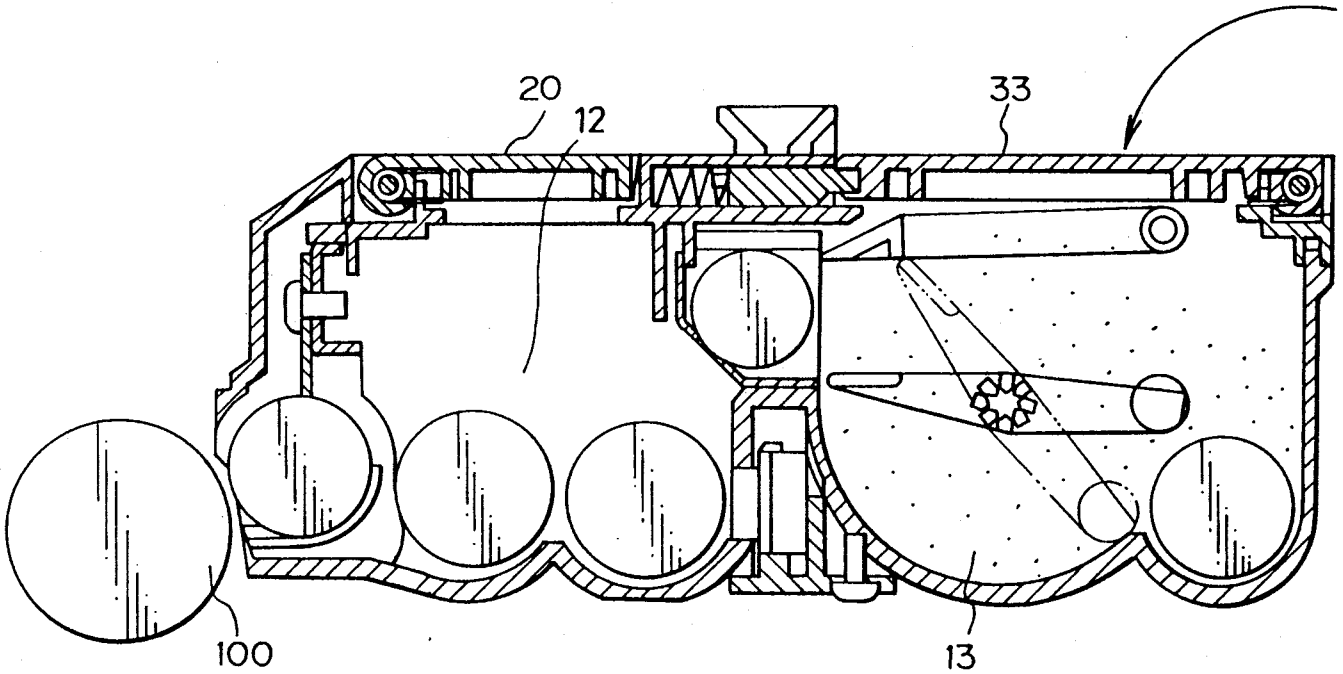
FIG. 18 represents a cross section of the developing apparatus after supply of the toner.

The toner is introduced into the replenishing tank 13 after taking off the seal member by rotating the handle 74 of the cartridge 70. After the replenishment of the the toner, the cartridge 70 is rotated again up to the position shown in FIG. 17 and the cartridge 70 is pulled out upward of the developing apparatus 10. When the supplying lid 33 is closed finally, the lock piece 42*a* is forced to move rearward against the spring 44 and is inserted into the hole 47, and then the supplying lid 33 is certainly locked as shown in FIG. 18. Thus the replenishment of the toner is completed.

This supply of the second developer is achieved only when the cartridge 70 is used, so that this can prevent the user from replenishing unsuitable developer into the replenishing tank 13.

Figure 9A:
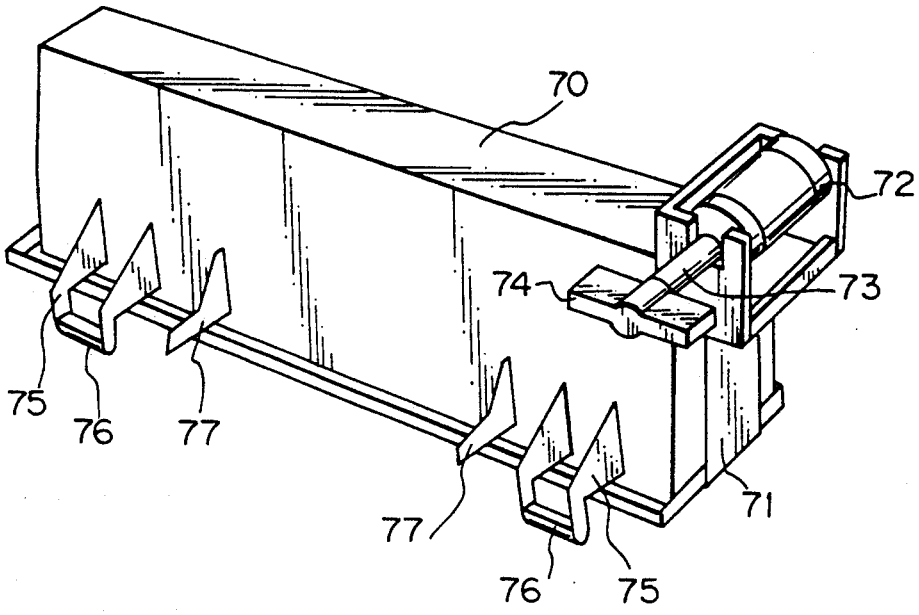
FIG. 9*a* represents a perspective view of the exclusive cartridge.
Figure 9B:
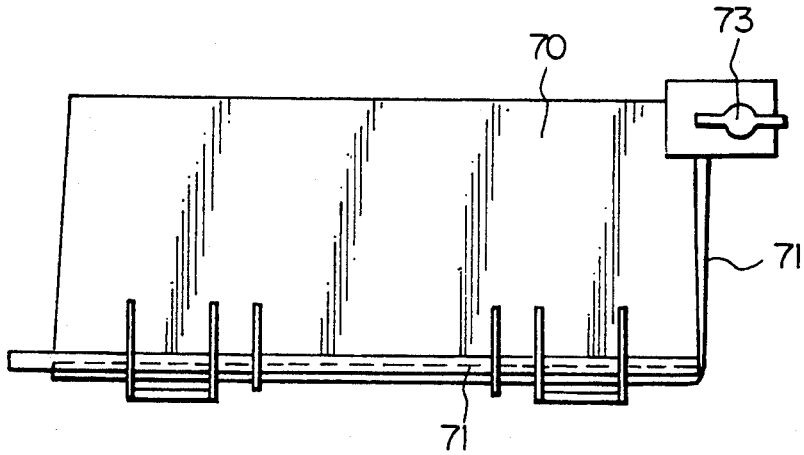
FIG. 9*b* represents a side view of the exclusive cartridge.

In order to facilitate the rotation of the cartridge 70 after mounting the cartridge 70 on the developing apparatus 10, it is necessary that the shaft 76 of the cartridge 70 has a sufficient long length (see FIG. 9*a*). If the length of the shaft 76 is shorter, the cartridge must be unstable during the rotation and the operation of supply is impossible as a result.

In a preferable embodiment, the lid 46*b* is disposed at an inner side with respect to the supporting portion 40 on the upper surface of the developing apparatus 10 (see FIG. 1). The reason is that the supplying lid 33 cannot be easily locked with occurrence of concave shaped warping on the supplying lid 33 if the position of the lid 46*b* is at an outer side. When the supplying lid 33 is closed, complete locking is carried out by pushing a middle portion of the supplying lid 33 even if the supplying lid 33 has the warping. Accordingly, the lock release piece 77 is disposed at an inner side with respect to the angle 75 on the side surface of the cartridge (see FIG. 9*a*).

The present invention is not limited to the above-mentioned embodiments, and it is a matter of course that many modifications and alterations may be added to the above-mentioned embodiments within a scope of the present invention.

Figure 19A:
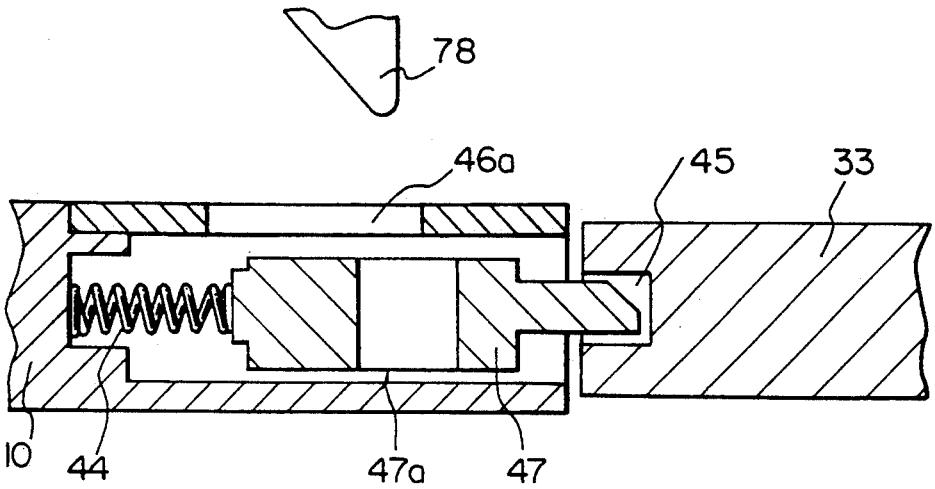
FIG. 19*a* represents a cross section of an example of the second locking means and the lock release means during the supplying lid being locked.
Figure 19B:
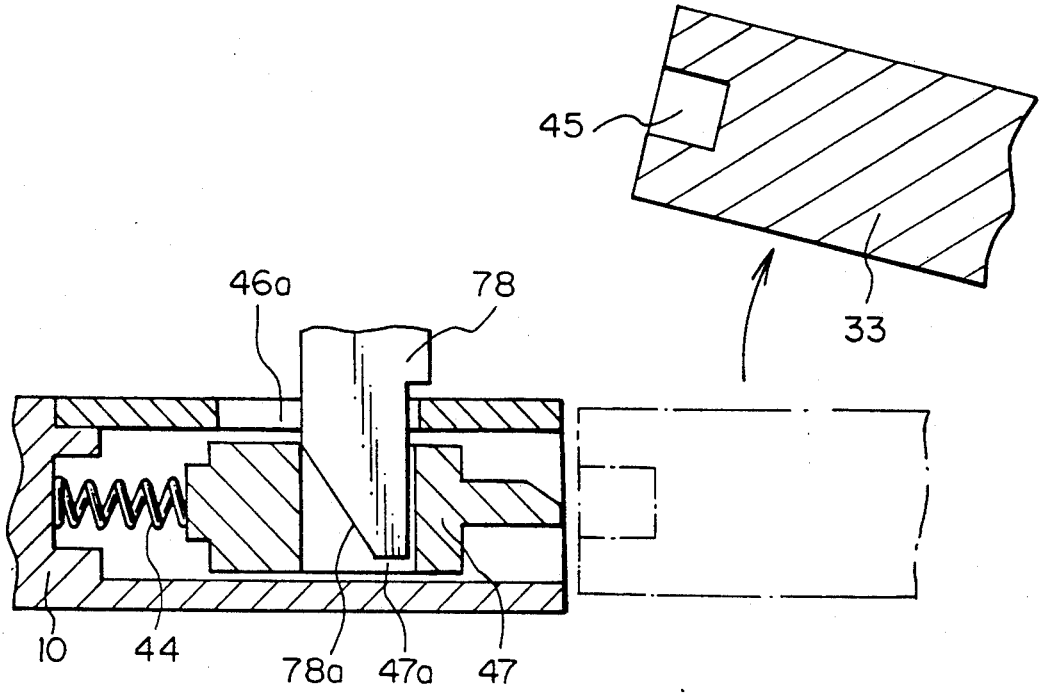
FIG. 19*b* represents a cross section of the second locking means and the lock release means shown in FIG. 19*a* during the supplying lid is opened.

For example, as shown in FIG. 19*a* and 19*b*, the lock release means 46 is constituted by a lock piece 47 having a penetrating hole 47*a* and a lock release piece 78 having a tapered surface 78*a*, and the same functions and advantages as those of the above-mentioned embodiments can be provided. Furthermore, the lock release piece 47 may be provided with a projected rod engaging the hole 45 of supplying lid 33.

Preferably, there is provided with a locking means and a lock release means for releasing the lock means for the developing tank, in place of the replenishing tank. In this case, the lock means may be attached at an inner side of an upper surface of a developing apparatus with respect to a supporting portion for supporting developer cartridge.

Many widely different embodiments of the present invention may be constructed without departing from the spirit and the scope of the present invention. It should be understood that the present invention is not limited to the specific embodiments described in the specification, except as defined in the appended claims.

What is claimed is:

1. A developing apparatus using a detachable developer cartridge comprising:

a developing tank with a developing roller and a first supplying opening for supplying a first developer containing magnetic particles;

a developer replenishing tank disposed adjacent to said developing tank, having a second supplying opening for supplying a second developer containing a non-magnetic developer.

first and second supplying lids disposed at said first supplying opening and said second supplying opening, respectively;

first locking means for locking said supplying lid at said first supplying opening in a closing position;

a second locking means for locking said supplying lid at said second supplying opening in a closing position; and a lock release means for releasing only said second locking means when said detachable developer cartridge is mounted on said developing apparatus.

2. A developing apparatus according to claim 1, wherein said second locking means includes a means for locking said second supplying lid automatically when it is closed, said locking means being not released during the use of said developing apparatus except that said detachable developer cartridge is mounted on said developing apparatus.

3. A developing apparatus according to claim 1, wherein said detachable developer cartridge comprises a release member, said lock release means of said developing apparatus engaging only said release member in order to release said second supplying lid.

4. A developing apparatus according to claim 1, wherein said first locking means includes a means for locking said first supplying lid when it is closed, said first locking means being not released during the use of said developing apparatus.

5. A developing apparatus according to claim 1, wherein said second locking means includes a first lock member disposed movably at a peripheral wall of said second supplying opening and a second lock member disposed at an edge of said supplying lid, said first lock member engaging said second lock member when said second supplying lid is closed.

6. A developing apparatus according to claim 5, wherein said first lock member includes a concave portion formed on a peripheral wall of said second supplying opening and a lock piece disposed in said concave portion, and said second lock member is a hole formed at an edge of said second supplying lid, said lock piece engaging said hole when said supplying lid is closed.

7. A developing apparatus according to claim 6, wherein said first lock member further comprises a spring fitted around a rod projected at an end portion of said lock piece and a forward end of said lock piece being tapered formed.

8. A developing apparatus according to claim 6, wherein said concave portion is provided with a stopper and said lock piece is provided with a groove, said stopper engaging said groove for preventing said lock piece from getting out from said concave portion.

9. A developing apparatus according to claim 1, wherein said first locking means includes a first lock member disposed at a peripheral wall of said first supplying opening and a second lock member disposed at an edge of said first supplying lid, said first lock member engaging said second lock member when said first supplying lid is closed.

10. A developing apparatus according to claim 9, wherein said first lock member includes a pawl disposed at an end portion of said first supplying lid and said second lock member includes a stop disposed at a peripheral wall of said first supplying opening.

11. A developing apparatus according to claim 1, wherein said detachable developer cartridge comprises a release member and said lock release means includes a first member disposed adjacent to said second locking means and a second member disposed at said second locking means, both said first member and said second member engaging said release member for releasing the locking of said second supplying lid.

12. A developing apparatus according to claim 11, wherein said first release member includes a lid having a opening disposed at an upper surface of the developing apparatus and said second release member includes a hole disposed at said second locking means, said hole engaging said release member of said detachable cartridge for releasing the locking of said second supplying lid.

13. A developing apparatus according to claim 12, wherein a aperture size of said hole is smaller step by step from the opening to the bottom.

14. A developing apparatus according to claim 1, wherein there is provided with a lock preventing means for preventing said first and second supplying lids from being locked respectably and from being opened before first supply of the first developer and the second developer to said developing apparatus.

15. A developing apparatus according to claim 14, wherein said lock preventing means comprises a lock preventing member disposed at an upper surface of said developing apparatus for preventing said first and second supplying lids from locking and a tape adhered to cover said lock preventing means and said supplying lids so as to prevent said supplying lids from opening.

16. A developing apparatus according to claim 14, wherein said lock preventing means includes a single sheet having functions for preventing said first and second supplying lids from being locked and for preventing said first and second supplying lids from being opened before first supply of the first developer and the second developer to the developing apparatus.

17. A developing apparatus according to claim 1, wherein there is provided with supporting members disposed at an upper surface of the developing apparatus for supporting said detachable developer cartridge during replenishment of said second developer, both said second locking means and said lock release means being at an inner side with respect to said supporting members on the surface of said developing apparatus.

18. A developer cartridge used for a developing apparatus having a locking means for locking a supplying lid disposed at an opening of a developer tank and a lock release means for releasing said locking means when said developer cartridge is mounted on said developing apparatus comprising:

a release member for releasing the locking fo said supplying lid of said developing apparatus by engaging said lock release means of said developing apparatus when said developer cartridge is mounted on said developing apparatus; and a pair of angles having a shaft so as to be fitted at a supporting member of said developing apparatus when the developer is replenished, wherein said release member includes a pair of lock release pieces attached at a side surface of said developer cartridge and at an inner side with respect to said angles.

* * * * *